US008499399B1

(12) United States Patent
Jones

(10) Patent No.: US 8,499,399 B1
(45) Date of Patent: Aug. 6, 2013

(54) ADJUSTABLE IN-PIPE BRUSH

(75) Inventor: Garrett Jones, Clovis, CA (US)

(73) Assignee: Laval Underground Surveys, LLC, Fresno, CA (US)

( * ) Notice: Subject to any disclaimer, the term of this patent is extended or adjusted under 35 U.S.C. 154(b) by 0 days.

(21) Appl. No.: 13/569,091

(22) Filed: Aug. 7, 2012

(51) Int. Cl.
*B08B 9/043* (2006.01)

(52) U.S. Cl.
USPC ..... 15/104.19

(58) Field of Classification Search
USPC ..... 15/104.19
See application file for complete search history.

(56) References Cited

U.S. PATENT DOCUMENTS 1,786,520 A * 12/1930 Darling ..... 15/104.19
2,599,077 A * 6/1952 Sturgis ..... 15/104.09
3,466,691 A * 9/1969 Wessel ..... 15/104.19
4,244,072 A * 1/1981 Dunham et al. ..... 15/104.095
7,121,336 B2 10/2006 Hatley

* cited by examiner

*Primary Examiner* — Randall Chin
(74) *Attorney, Agent, or Firm* — James M. Duncan, Esq.; Klein, DeNatale, Goldner

(57) ABSTRACT

A device for cleaning the interior of a pipeline includes an axial support, a first collar fixedly attached to a first location on the axial support, a second collar fixedly attached to a second location along the axial support, and a third collar slidingly engaged with the axial support. The second collar is located between the first collar and the third collar. A flexible support is fixedly attached to the third collar and the first collar and extends between the two. Brush members are disposed along an exterior surface of the flexible support. When the third collar is at a first position along the length of the axial support, the flexible support is distended. When the third collar is at a second position along the length of the axial support, where the second position is more distant from the first collar than the first position, the flexible support is flattened.

16 Claims, 7 Drawing Sheets

ADJUSTABLE IN-PIPE BRUSH

RELATED APPLICATIONS

Not Applicable.

BACKGROUND OF THE INVENTION

1. Field of the Invention

The present invention relates generally to a device for cleaning a bore or pipe, and specifically to an adjustable device for cleaning casings and liners in oil, gas, and water wells, as well as slots or perforations in the casings or liners.

2. Background

Wells for oil and gas production typically include a central bore drilled from the surface to the reservoir of oil or gas beneath the surface. The bore is often lined with a steel pipe known as a "casing," which is typically cemented in place. At various times over the life of a well, performance of the well may be improved by cleaning the casing. Cleaning can improve the flow efficiency of the well and also insure that in-line inspection tools can be used to adequately visualize the casing to inspect for damage. Likewise, cleaning can remove unwanted debris, such as scale or paraffins, from slots or perforations in the casing or liner of a well. These and other reasons for properly cleaning an oil, gas, or water well are known and understood in the art.

A brush used to clean a pipeline must have dimensions that allow the bristles of the brush to contact the walls of the casing or liner with enough force to remove the debris therefrom. The casing may, however, have different levels of clearance at different points along its length. Thus, a brush sized to clean one portion of the casing may be too large to penetrate another area of the casing, particularly if significant accumulations of debris are present, or when a liner is encountered, and so on. Likewise, a brush that is small enough to penetrate the heavily obstructed areas may be too small to adequately clean the less obstructed areas.

SUMMARY OF THE INVENTION

The present invention provides a device for cleaning the casing or liner of an oil, gas, or water pipeline. The device includes an axial support, a first collar fixedly attached to a first location on the axial support, a second collar fixedly attached to a second location along the axial support, and a third collar slidingly engaged with the axial support. The second collar is located between the first collar and the third collar. A spring is fixedly attached to the second collar and the third collar and extends between the two. A flexible support is fixedly attached to the third collar and the first collar and extends between the two. A plurality of brush members are disposed along an exterior surface of the flexible support. When the third collar is at a first position along the length of the axial support, the flexible support is distended. When the third collar is at a second position along the length of the axial support, where the second position is more distant from the first collar than the first position, the flexible support is flattened.

Another aspect of the invention provides that the axial support includes an upper end and a lower end when considered in operable position for insertion into a vertical pipeline. A cable is fixedly attached to the upper end of the axial support.

Another aspect of the invention provides that a tube is attached to the upper end of the axial support.

Another aspect of the invention provides that a down view camera is fixedly attached to the second end of the axial support.

Another aspect of the invention provides that a light source is fixedly attached to the second end of the axial support.

Another aspect of the invention provides that a side view camera is fixedly attached along the length of the axial support.

Another aspect of the invention provides a light source fixedly attached along a length of the axial support, the light source positioned to provide light to an area visualized by the side view camera.

Another aspect of the invention provides that the third collar is selectively positionable by an operator of the device.

Still another aspect of the invention provides a device for cleaning the interior of a pipeline casing, the device including at least one axial support, a first collar attached to the axial support at a first location, a second collar attached to the axial support at a second location, and a flexible support attached to the first collar and the second collar and extending therebetween. The second collar slides between a first and second position, with the at least one flexible support being distended when the second collar is at a first position, and flatter when the second collar is at a second position.

In another aspect of the invention, the flexible support includes three members. The first member is attached to a first collar, the second member is hingedly attached to the first member, and the third member is hingedly attached to the second member and fixedly attached to a second collar.

DETAILED DESCRIPTION OF THE INVENTION

Figure 1:
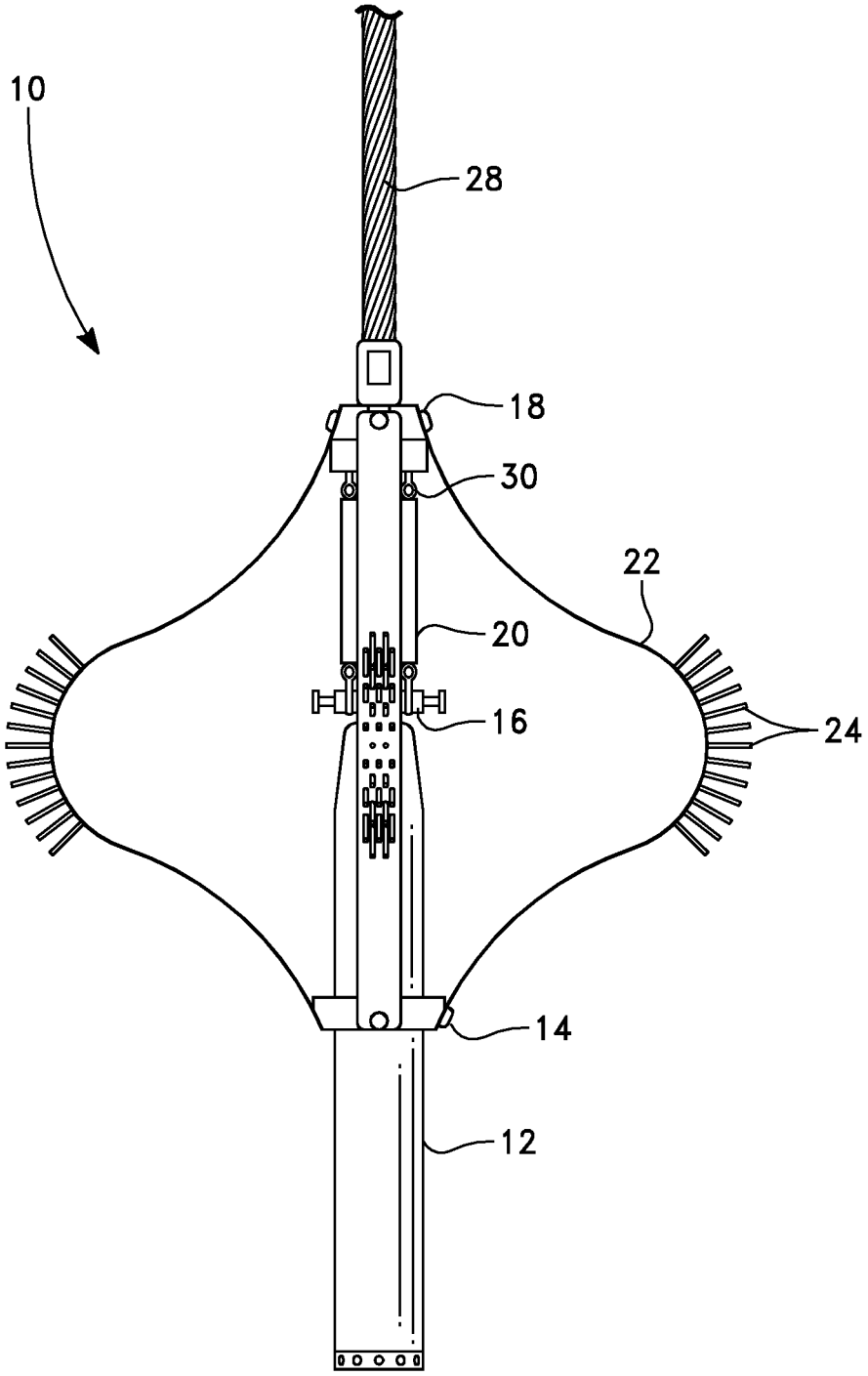
FIG. 1 is an elevation view of one exemplary embodiment of an adjustable in-pipe brush of the present invention.

Turning now to the drawings, wherein like numerals indicate like parts, the numeral 10 refers generally to one embodiment of an adjustable in-pipe brush of the present invention. Adjustable in-pipe brush 10 preferably includes an axial support 12, first collar 14, second collar 16, third collar 18, springs 20, flexible supports 22, and brush members 24.

FIG. 1 depicts an exemplary embodiment of an in-pipe brush of the present invention. Adjustable in-pipe brush 10 is shown oriented as in use upon insertion into a vertical pipeline casing. It should be noted that the pipeline cleaned by in-pipe brush 10 need not be vertical, but may instead be horizontal or at any other angle. As shown in the figure, axial support 12 is preferably an elongate, generally cylindrical support on which the various other components of the present invention can be disposed. Axial support 12 may, for example, be a metal rod, pipe, tube, or other rigid structure capable of supporting the weight of the other components of the present invention. The length and width of axial support 12 may vary as necessary or desirable according to the dimensions of a given pipeline in which the present invention is to be used. Axial support 12 may be constructed of any of a variety of suitable materials, including ductile iron, stainless steel, or any of a variety of suitable synthetic polymers.

A first collar 14 is fixedly attached to axial support 12 at a desired point along the length of axial support 12. The precise location of attachment of first collar 14 may be varied as necessary or desirable given the precise use of the present invention.

In one embodiment of the invention, first collar 14 is attached to axial support 12 below a midline thereof (as determined when the invention is in operable position for insertion into a vertical pipeline). In other embodiments of the invention, first collar 14 may be attached to axial support 12 at or near the midpoint of axial support 12, leaving a greater length of axial support 12 extending beneath first collar 14 than shown in FIG. 1. As with axial support 12, first collar 14 may be constructed of a variety of suitable materials, including ductile iron, stainless steel, or suitable synthetic polymers. First collar 14 may be affixed to axial support 12 by any suitable method, including by welding, use of adhesives, or by use of screws, bolts, or other suitable fasteners.

Second collar 16 is also preferably fixedly attached to axial support 12. Second collar 16 is attached along the length of axial support 12 at a point above first collar 14 (again, considering the device 10 as oriented for insertion into a vertical pipeline). Methods for attaching second collar 16 to axial support 12, as well as suitable materials for constructing second collar 16, are varied, as described above with respect to first collar 14. Second collar 16 preferably includes a fastener 28 for attachment of spring 20 thereto, as described below.

Third collar 18 is provided in sliding engagement along a length of axial support 12. Third collar 18 is preferably able to move freely along the length of axial support 12, within limitations defined by the other structural components of the present invention. Third collar 18 preferably includes a fastener 30 attached thereto, the fastener for securing the other end of spring 20, attached to second collar 16.

Also attached to third collar 18 is flexible support 22. Flexible support 22 may be a flattened band, as shown in the Figures, or other suitable structure capable of serving the purpose of flexible support 22 of the present invention. Flexible support 22 is preferably constructed of steel or other suitable metal, but it is contemplated that other suitable materials, such as synthetic polymers, may also be used. The end of flexible support 22 not attached to third collar 18 is attached to first collar 14, and the flexible support 22 extends between the two collars.

In some embodiments of the present invention, when in a normal position, where there is no force being applied to flexible support 22, flexible support 22 has a curved or outwardly-protruding shape as shown in the Figures. This is the distended position of flexible support 22. Thus, flexible support 22 functions as a flat spring, for example. When force is applied to flexible support 22, flexible support 22 tends to flatten and may in fact be forced into a substantially flat shape. When the force is removed, however, flexible support 22 assumes its starting configuration shown in the Figures. In such embodiments of the invention, springs 20 are not needed, as the natural tendency of flexible supports 22, in functioning as flat springs, will cause distension of flexible supports 22 to the extent allowed by the internal diameter of the pipeline and cause a corresponding movement of third collar 18. In other embodiments of the invention, as shown in the Figures, flexible members 22 are not sufficient to bias themselves as in the case of flat spring-style embodiments, and instead springs 20 are employed to tend to distend flexible members 22 as permitted by the internal diameter of the pipeline.

Flexible support 22 includes a plurality of brush members 24 extending from an outwardly-facing surface thereof. Brush members 24 are preferably wire brushes, though other suitable brushes known in the art may be employed. Brush members 24 are fixedly attached to flexible support 22, such as by welding, in the case of wire brushes. Any suitable method of affixing brush members 24 to flexible support 22 may be employed, though brush members 24 should be affixed in such a manner as to prevent the inadvertent detachment of brush members 24, or portions thereof, within the pipeline casing. Likewise, brush members 24 should be constructed of a material that does not easily break or shed portions thereof so that pieces of brush members 24 are not dislodged within a pipeline casing during the cleaning process.

Flexible supports 22 are preferably removable from the collars to which they are secured, allowing the replacement of flexible supports 22 as necessary or desired, such as when the flexible supports 22 themselves, or brush members 24, become worn or otherwise unsuitable for use. It is also contemplated that flexible supports 22 of varying lengths may be used in conjunction with the present invention, and that longer or shorter flexible supports 22 may be attached to any given embodiment of the present device as needed for pipelines with varying diameters.

Flexible supports 22 may be of varying rigidity according to the desires of a user of the present device, or the needs relating to a particular use or application of the device. In general, flexible supports 22 should have sufficient rigidity to press brush members 24 into the perforations of a pipeline casing in order to clean them, but should not be so rigid as to damage the casing. The structural features of the present invention allow the necessary rigidity to be provided, but prevent damage to the casing because flexible supports 22 are able to contract, or to be pushed inward, by the casing before exerting sufficient pressure on the casing to damage it. This provides an important advantage over devices with fixed brushes, because fixed brushes do not give when encountering resistance from the casing and are therefore prone to damaging the casing.

The embodiment of the present device shown in FIG. 1 employs four flexible supports 22, though only three are visible in the drawings. It is contemplated, however, that any suitable number of flexible supports 22 may be provided. As few as two may be provided, and as many as needed to entirely cover a circumference of axial support 12 may also be provided. Further, although flexible supports 22 are shown as extending in a substantially straight fashion along the length of axial support 12, it is contemplated that they may also be provided in a more helical arrangement, such that flexible supports 22 collapse onto axial support 12 when flattened, but distend and rotate outward when forced to do so by the movement of third collar 18.

Figure 2:
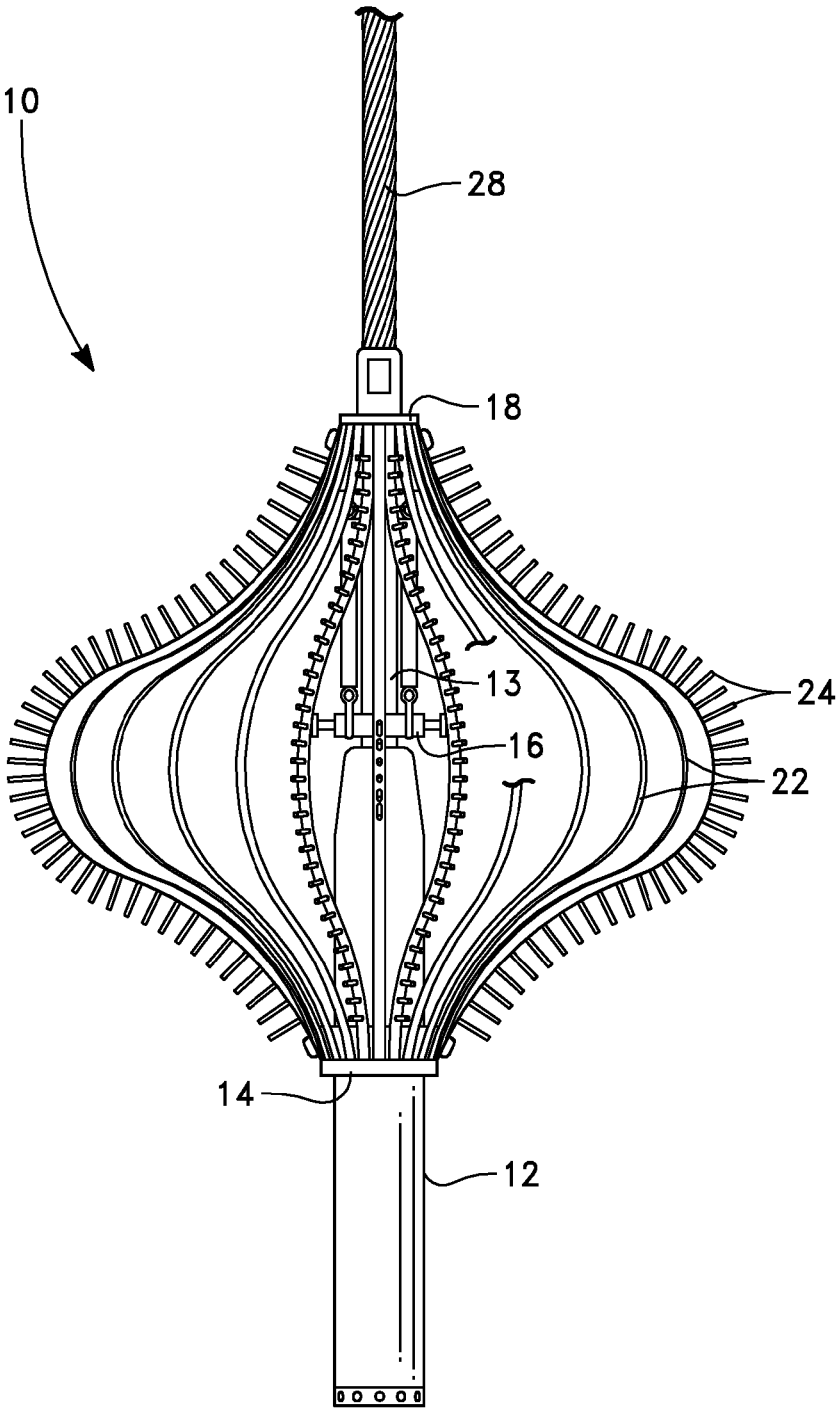
FIG. 2 is an elevation view of a second exemplary embodiment of an adjustable in-pipe brush of the present invention.

FIG. 2 depicts one alternative embodiment of the present device, the embodiment including a greater number of flexible supports 22 than the embodiment shown in FIG. 1. The greater number of flexible supports 22, and the corresponding greater number of brush members 24, provide a greater cleaning surface area to the device. The flexible supports 22 may be arranged as shown in the drawing, or may be disposed around the perimeter of axial support 12 in a helical fashion, collapsing onto axial support 12 when third collar 18 is moved further away from first collar 14.

Also shown in FIG. 2 is an axial shaft 13 on which second collar 16 and third collar 18 are disposed. Axial shaft 13 preferably extends between axial support 12 and cable 28. Second collar 16 is preferably fixedly attached to axial shaft 13, whereas third collar 18 is preferably slidingly engaged therewith. Springs 20 maintain a tension between second collar 16 and third collar 18, maintaining a predetermined distance therebetween, and therefore a predetermined extension of flexible supports 22 when flexible supports 22 are not impacted by any other force. The action of a casing wall or obstruction pushing against flexible supports 22 causes third collar 18 to travel along axial shaft 13, thereby allowing flexible supports 22 to flatten as required by an interior wall of the casing or an obstruction therein. In some embodiments, the action of an operator of the present invention may also cause extension or flattening of flexible supports 22. This may occur, for example, when an operator pulls on cable 28, thereby pulling third collar 18 upwardly and away from second collar 16.

Figure 3:
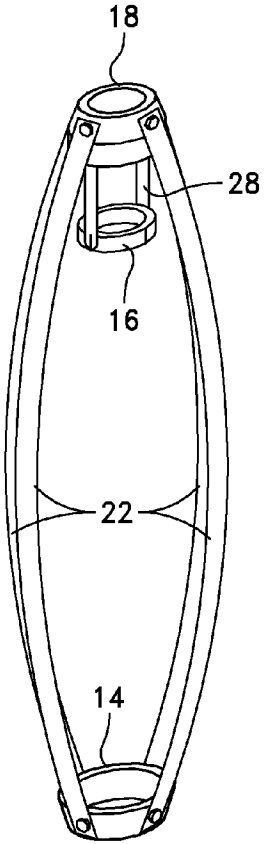
FIG. 3 is a perspective view of one embodiment of the flexible supports and collars of the present invention.

FIG. 3 provides a perspective view of one embodiment of the flexible supports 22, first collar 14, second collar 16, and third collar 18 of the present invention. The combination of these components of the present invention may be referred to herein as a "flexible support and collar assembly." The flexible support and collar assembly is shown in FIG. 3 in an uncompressed state. As shown, flexible supports 22 extend between first collar 14 and third collar 18. Springs 20 extend between second collar 16 and third collar 18. Fasteners 28 secure the fixed collars to the axial support (not shown).

Figure 4:
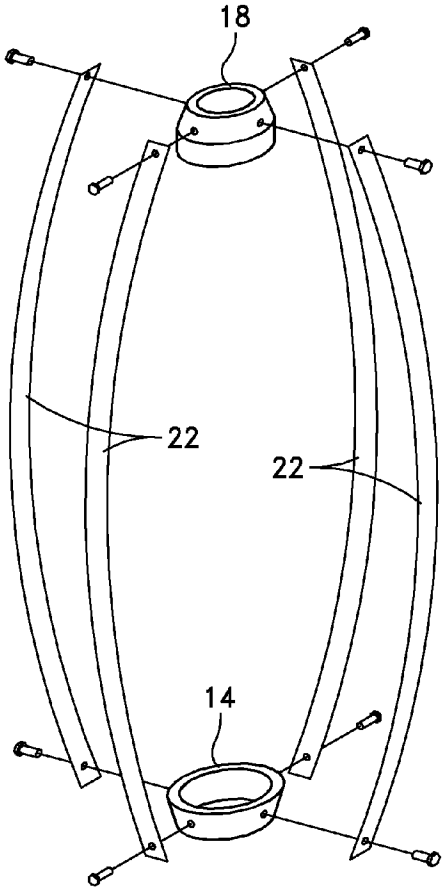
FIG. 4 is an exploded view of the embodiment of the flexible supports and collars of the present invention shown in FIG. 3.
Figure 5:
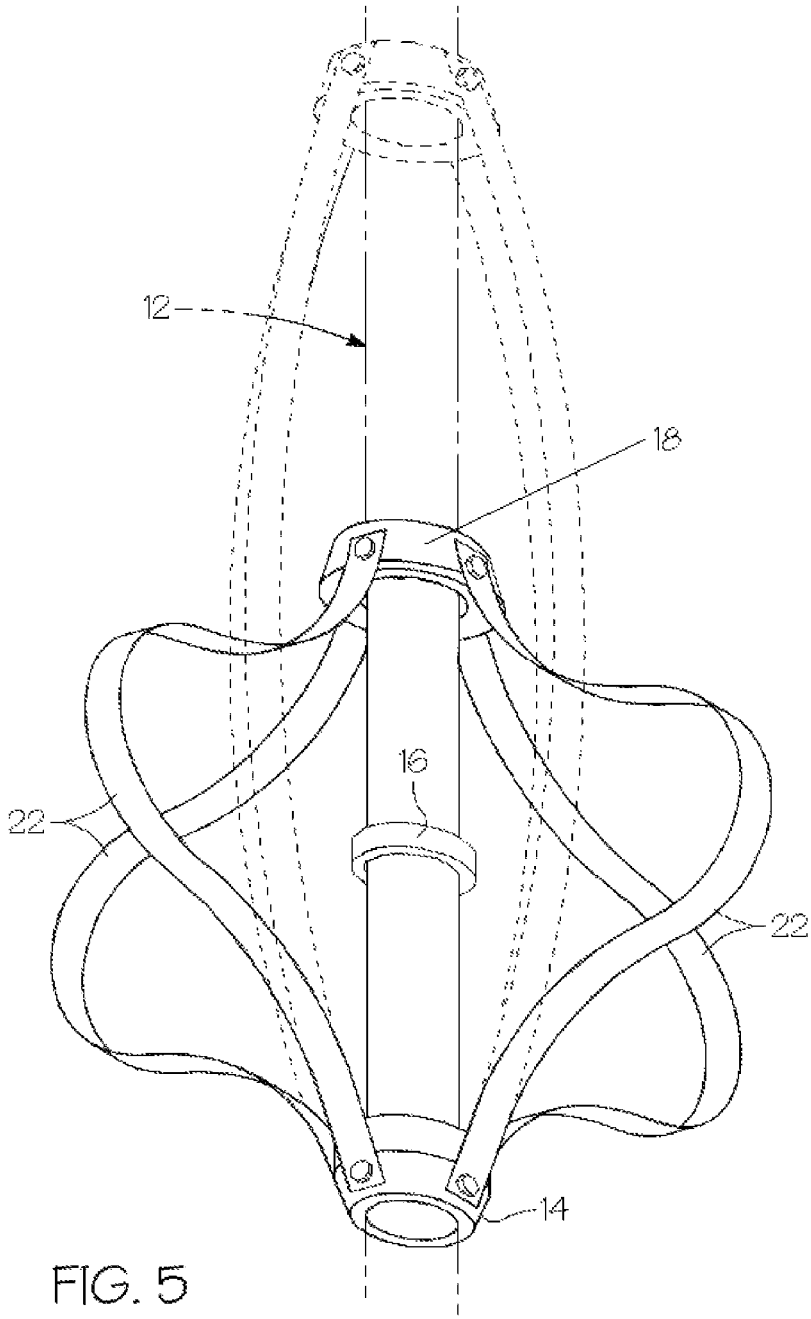
FIG. 5 is a perspective view of the embodiment of the flexible supports and collars of the present invention shown in FIG. 3, the flexible supports being in a an distended state, with phantom lines showing the flexible supports in a flattened state.

FIG. 4 provides an exploded view of the flexible support and collar assembly shown in FIG. 3. FIG. 5 shows an assembled flexible support and collar assembly, but in a compressed state, with first collar 14 and third collar 18 closer to one another than shown in FIG. 3. Phantom lines are employed in FIG. 5 to show the relative configuration of the present device as flexible supports 22 move between a distended and flattened state. In the embodiment of the invention shown in FIG. 5, axial support 12 is shown in phantom lines. The phantom lines in FIG. 5 show third collar 18 at a point more distant from second collar 16 than that shown by the solid lines. Flexible supports 22 are correspondingly flattened in the phantom lines. As third collar 18 travels downward along axial support 12, moving close to second collar 16, flexible supports 22 become distended. Springs 20 are not shown in FIG. 5, in order to provide a more clear view of the second collar 16, third collar 18, and their locations along axial support 12. It is, however, contemplated that the embodiment shown in FIG. 5 may employ springs 20 extending between second collar 16 and third collar 18.

Figure 6:
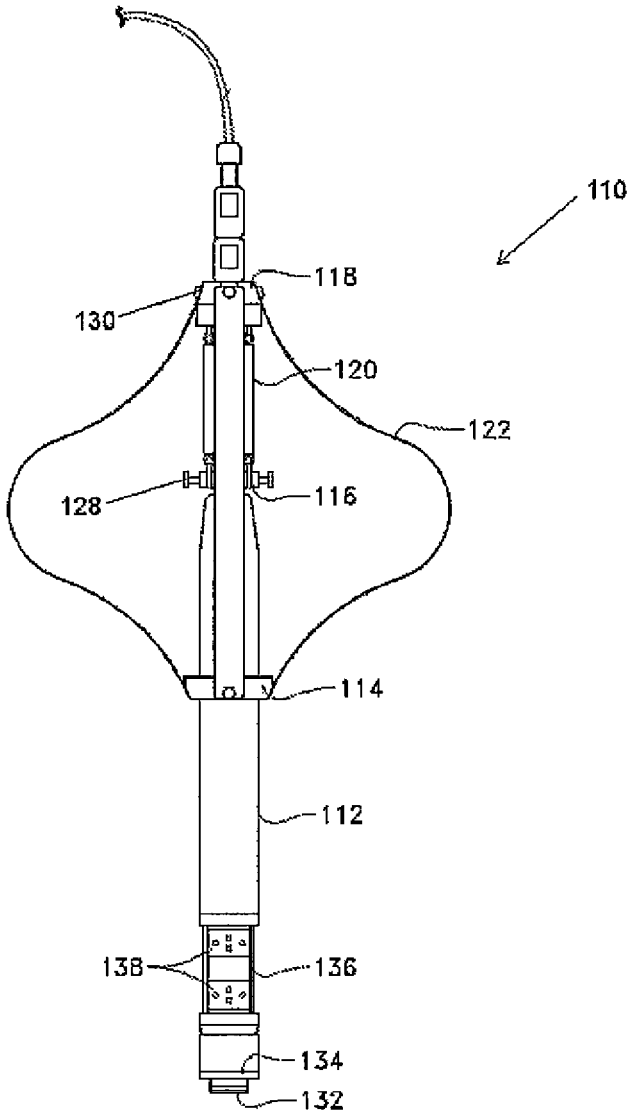
FIG. 6 is an elevation view of a second exemplary embodiment of an adjustable in-pipe brush of the present invention, the embodiment including down view and side view cameras.

FIG. 6 depicts another alternative embodiment of adjustable in-pipe cleaner 110, shown as oriented for insertion into a vertical pipe. In-pipe cleaner 110 includes an axial support 112, first collar 114, second collar 116, and third collar 118. Second collar 116 includes fasteners 128 and third collar 118 includes fasteners 130. Springs 120 extend between fasteners 128 and 130 of second collar 116 and third collar 118, respectively. Also included in this embodiment of the invention are flexible supports 122. Brush members are disposed along the surface of flexible support 122, as in previously described embodiments of the present invention. The brush members are not depicted in FIG. 6. The relative positions of third collar 118 and second collar 116, and the corresponding distension and flattening of flexible supports 122 is as described with respect to the first embodiment of the invention, above.

In-pipe cleaner 110 further includes a first, down view camera 132 at the lower end of axial support 112 (when axial support is oriented for use in a vertical pipeline. The terms "upper" and "lower" end with respect to axial support 112 are used herein interchangeably with "first" and "second" end, respectively). The presence of down view camera 132 at the lower or second end of axial support 112 allows visualization of the inside of a pipeline casing as in-pipe brush 110 is traveling therethrough. A light source 134 is preferably provided at the second end of axial support 112 in order to generate light so that down view camera 132 can visualize the interior of the casing. Any suitable light source may be employed, though it is preferred that high-intensity LEDs are utilized.

Down view camera 132 is preferably in communication with an operator of the present device. The operator can see the interior of the pipeline casing in real time and adjust the operation of device 110 accordingly. Communication between down view camera 132 and the operator may be accomplished in any suitable manner, and ways of establishing such communication are well-known in the art. Exemplary methods of communication between the down view camera 132 and the operator of device 110 include fiber optic communication between the camera 132 and equipment utilized by the operator, communication along a coaxial cable, and wireless communication. It is also contemplated that in some embodiments of the invention, in-pipe brush 110 may be provided with components for recording the images visualized by down view camera 132.

In-pipe brush 110 may further include a side view camera 136 for visualization of the walls of a pipeline casing in which in-pipe brush 110 is being used. The presence of camera 136 allows an operator of in-pipe brush 110 to view directly the side walls of a pipeline casing, or the perforations or slots in the casing, so that obstructions or accumulations of material may be better visualized. Light source 138 is provided to illuminate the interior of the casing for visualization by camera 136. Light source 138 may be a plurality of high-intensity LEDs, as shown in the figure, or may include any suitable source of illumination. It is contemplated that side view camera 136 is in communication with an operator of in-pipe brush 110 in the same manner as down view camera 132. Optionally, side view camera 136 may also be in communication with a recording device to allow recording of the images of the interior of the pipeline casing visualized by side view camera 136.

Figure 7:
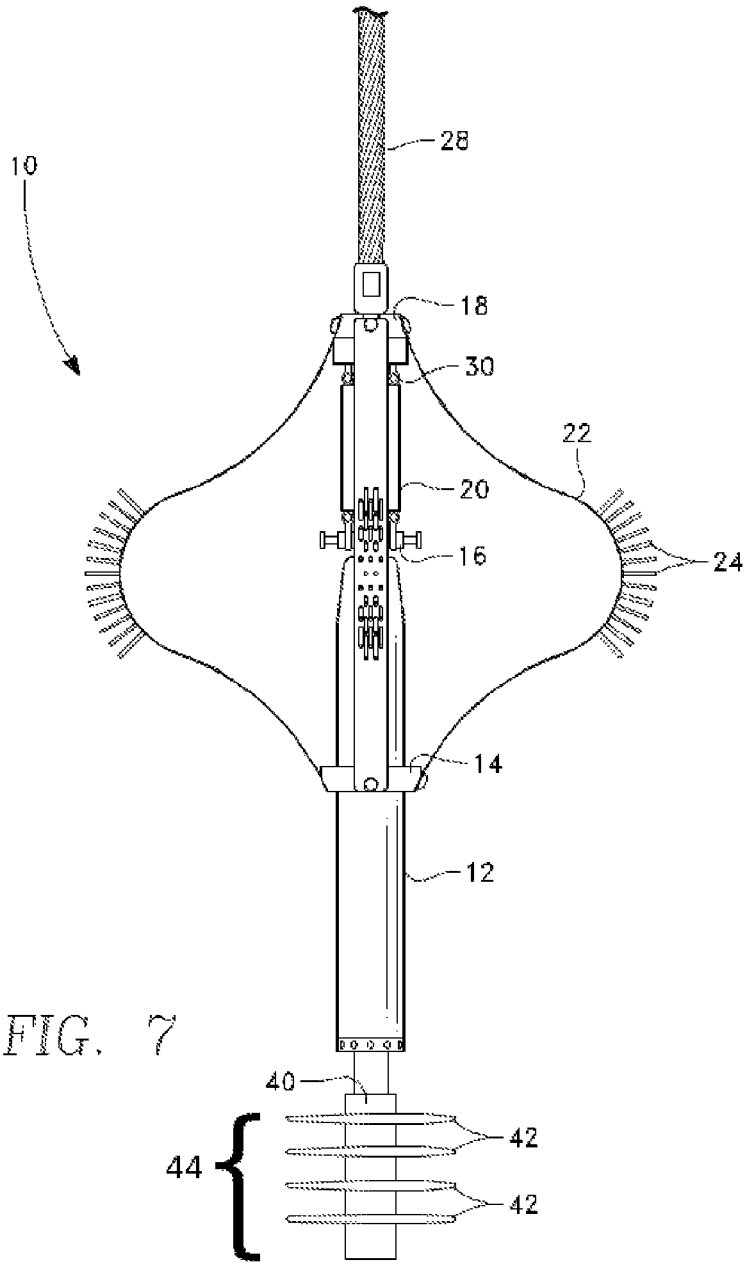
FIG. 7 is an elevation view of an exemplary embodiment of an adjustable in-pipe brush of the present invention, the embodiment including a surge block.

FIG. 7 depicts yet another alternative embodiment of the present invention. The embodiment of an in-pipe brush shown in FIG. 7 is substantially similar to the embodiment shown in FIG. 1, except that FIG. 7 includes the addition of a surge block 44 to the device. Surge block 44 is attached to the lower end of axial support 12, when oriented in operable position for insertion into a vertical pipeline. Surge block 44 includes a central shaft 40, about which are disposed a plurality of seals 42 that engage the walls of a pipeline when surge block 44 is inserted within the pipeline.

Figure 8:
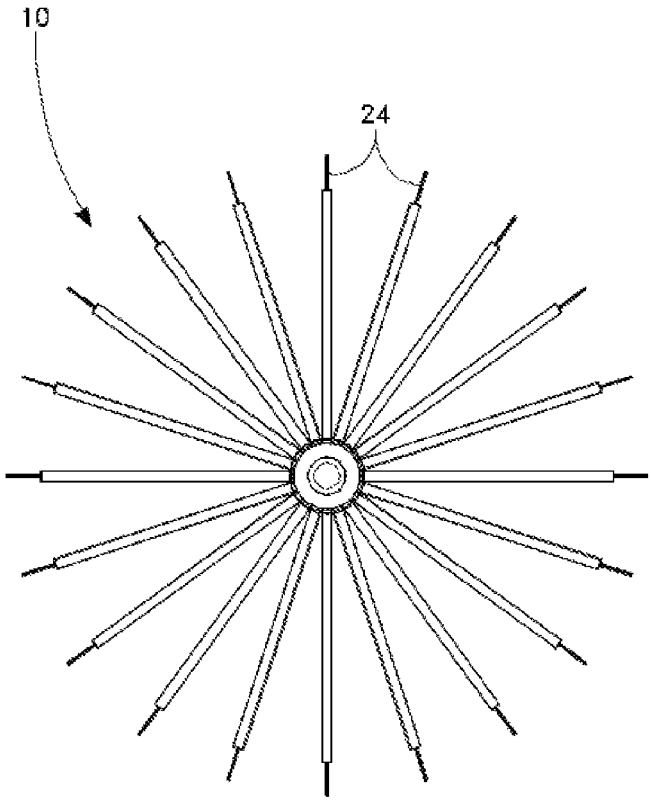
FIG. 8 is a top view of one embodiment of an adjustable in-pipe brush of the present invention.

FIG. 8 depicts a top view of an exemplary embodiment of an adjustable in-pipe brush of the present invention. Adjustable in-pipe brush 10 includes a plurality of flexible supports with brush members 24 extending therefrom. The figure shows one possible arrangement of flexible supports and brush members, as seen from the top of the device. It is contemplated that any suitable number of flexible supports with brush members may be provided, from at least two through any amount able to be fit onto the perimeter of the device.

Embodiments of the present device having surge block 44 associated therewith may be useful in rehabilitation of a well or pipeline. The seals 42 of surge block 44 operate in the manner of a plunger, beneath the level of fluid in a pipeline. In some embodiments of the invention, surge block 44 may also be provided with a one-way valve, allowing for the down stroke of surge block 44 to be more mild than the upstroke because fluid passes through the one-way valve on the down stroke. Embodiments of the present device including a surge block 44 with a one-way valve preferably utilize tubing to form axial support 12. The one-way valve may be provided within the tubing to allow fluid flow therethrough. Any suitable tubing may be utilized, including tubing made from high-density polyethylene, low-density polyethylene, and polytetrafluoroethylene (PTFE). The use of such tubing, and of surge blocks, is known and understood in the art, though the use of these in association with the in-pipe brush of the present invention is novel.

In addition to the embodiments of the present invention described above, various other embodiments of the present invention may also be utilized. Exemplary alternative embodiments of the present invention are described here and elsewhere in this writing. In some embodiments of the invention, for example, springs 20 may be eliminated, with flexible supports 22 acting as flat springs, tending to distend such that brush members 24 engage the walls of a casing, but flattening under pressure when a force from a casing wall or obstruction within a casing is applied to flexible supports 22.

In other embodiments of the present invention, flexible supports 22 may each be comprised of a plurality of flat pieces rather than a single piece as shown in the Figures. For example, a flexible support 22 may be comprised of three flat pieces, the first fixedly attached at one end to third collar 18 and at the other end via a hinged mechanism to a second flat piece of flexible support 22. The second, or middle piece, then, is attached at one end to the first piece and at the other end to the third piece. The attachment of the second piece to the third piece is also via a hinged mechanism. The third piece of flexible member 22 is attached to first collar 14 at the end opposite that attached to the second piece of flexible member 22. The hinged connections between the first and second pieces and the second and third pieces allow the flexible support 22 to flatten when third collar 18 is distant from second collar 16. When third collar 18 moves closer to second collar 16, however, flexible supports 22 distend. The hinges between the pieces of flexible support 22 allow the middle piece of flexible support 22 to present a substantially flat profile to the casing wall. In such embodiments of the present invention, it may be that only the middle piece of flexible support 22 includes brush members 24. Although three pieces make up flexible support 22 in the embodiment described above, it is contemplated that any suitable number of pieces may be employed.

A description of an exemplary method of operating the in-pipe brushes of the present invention is now provided. In embodiments of the invention that do not include cameras, the interior of a pipeline casing may, if desired, be visualized with a camera prior to insertion of adjustable in-pipe brush 10. The depth at which an obstruction or surface to be cleaned is identified may be marked, and in-pipe brush 10 may be inserted into the pipeline to the appropriate depth so that cleaning may begin. As in-pipe brush 10 travels through the pipeline, springs 20 maintain a tension between second collar 116 and third collar 118, pulling the two together and allowing flexible supports 22 to be distended (in embodiments where flexible members 22 act as flat springs, and no springs 20 are utilized, then flexible members 22 themselves maintain the tension between the second and third collars). As in-pipe brush 10 travels through the pipeline, the walls of the casing exert pressure against flexible supports 22 and brush members 24, having the tendency to push them flat. Springs 20 give in response to this pressure, enough so that while brush members 24 remain firmly in contact with the interior wall of the pipeline, they do not exert sufficient force to damage the walls of the pipeline. The precise distance between the second collar 116 and third collar 118 may be adjusted manually prior to insertion of device 10 into a pipeline, and thus the requirements of varying pipelines, having varying internal diameters, may be met.

As device 10 moves through areas of the casing wherein unwanted debris obstructs the interior of the casing, this narrowing of the internal diameter of the pipeline exerts additional force against flexible supports 22. Flexible supports 22 are therefore pushed inward, flattening sufficiently to pass through the narrower region of pipe. Springs 20 allow third collar 18 to move away from second collar 16, but maintain sufficient force on third collar 18 to allow it to move closer again, and therefore to allow flexible supports 22 to distend further, as the internal diameter of the casing increases. An operator of the device may move in-pipe brush 10 back and forth along the area of the pipeline casing in need of cleaning.

In addition to flattening and distending through varying internal diameters of a pipeline casing, flexible supports 22 ensure that brush members 24 are firmly engaged with the walls of the casing at any given location, and, as such, that brush members 24 are able to clean slots or perforations in the casing in addition to cleaning material away from the internal surface of the casing. Again, an operator of device 10 can position the device properly and move the device back and forth in an area where slots or perforations in the casing are obstructed or otherwise in need of cleaning. Brush members 24 are preferably constructed of wire or synthetic polymers (such as, for example, polypropylene) that have sufficient strength and rigidity to allow brush members 24 to clean the walls of the casing, as well as the slots and perforations therein, without the bristles of brush members 24 breaking during the cleaning process. After the cleaning process has been completed, a camera or other device for visualizing the interior of a casing may be used to determine how successfully the interior of the casing has been cleaned. If necessary, in-pipe brush 10 may be inserted again to clean areas still in need of cleaning, and this process may be repeated as often as necessary or desirable.

Embodiments of the present invention including down view and/or side view cameras allow for an easier and more accurate cleaning process. Down view camera 132 is able to identify obstructions along the length of the pipeline casing that obstruct or narrow the internal diameter thereof. An operator using the present invention may then clean the casing at the point at which the obstruction or debris is visualized, rather than relying on a depth measurement from prior visualization of the interior of the casing. Side view camera 136, if present, may be used to visualize the side walls of the casing directly, to show debris that may remain after the casing has been partially cleaned, or build up of debris that is not yet significant enough to be visualized by down view camera 132, but is nevertheless desirable to remove. Side view camera 136 may also show debris or obstructions within slots or perforations of the casing. In any of these situations, an operator of the present invention may move in-pipe brush 110 back and forth in a cleaning motion, and then may position in-pipe brush 110 within the pipeline casing so as to determine whether the cleaning has been successful or whether additional cleaning is required. Thus, the cleaning process can be completed without the need to remove in-pipe brush 110 from the interior of the pipeline and to separately visualize the interior of the casing with another device.

In any of the embodiments of the present invention described above, once the cleaning of the interior of the pipeline casing is completed, the in-pipe brush is removed from the casing. This is accomplished by simply pulling the device from the casing using cable 28 or, in some embodiments of the invention, the tube used in place of cable 28 to insert the present device into the casing. The pulling force on cable 28 preferably causes third collar 18 to move away from second collar 16, thereby forcing flexible supports 22 to flatten to some extent (they may flatten partially or completely, depending on the force applied to third collar 18, the counteracting force provided by springs 20 (if present), and the like. The extent of flattening may be any desired extent as determined by an operator of the device). This flattening of flexible supports 22 allows the in-pipe brush 10 to be more readily removed from the interior of the casing, without contact between flexible supports 22 and brush members 24 hindering the progress of in-pipe brush 10 out of the pipeline.

In the embodiments of the in-pipe brush described above, the extent of distension of flexible members 22 is determined by forces exerted against flexible members 22 by the walls of a casing, the forces of springs 20, and the force exerted against third collar 18 when device 10 is being removed from the casing. It is contemplated, however, that other methods of adjusting the distension of flexible members 22 may be utilized. For example, in some embodiments of the invention, third collar 18 may be maintained in a fixed position at any given time, but with that position adjustable by mechanical or motorized means as desired by an operator of the device. In other words, the forces of the interior walls of the casing against flexible members 22 do not move the third collar 18, and springs 20 are not utilized. Instead, third collar 18 moves relative to second collar 16 only at the direction of the operator of the present device. This may be accomplished in any suitable manner. For example, use of a stepper motor and worm gear combination may allow an operator of the present device to selectively position third collar 18 at any given time. Likewise, a solenoid may be employed for this purpose. Other methods of selectively positioning third collar 18 along a length of axial support 12 will be readily apparent to those of skill in the art upon reading this disclosure.

It is also contemplated that in some embodiments of the invention, a combination of selective positioning of the third collar 18 by an operator, and positioning by forces operating within the interior of the pipeline casing, may be used. In such embodiments, for example, third collar 18 may be "locked" or "unlocked" at the discretion of the operator. When unlocked, third collar 18 functions as described with respect to the first embodiments 10 and 110 detailed herein, wherein the walls of the interior of the pipeline and the force exerts by springs 20 cooperate to ensure that flexible supports 22 are firmly engaged with the interior walls of the casing. Should the operator choose, however, the operator of the device may lock the third collar, at which point the third collar 18 moves only in response to direct commands from the operator, as described above.

In addition to serving to clean a pipeline or casing, as noted above, it is further contemplated that the present device is useful in the rehabilitation of a well. The present device may be used to create a surging effect within the pipeline. If chemical treatments are being used to rehabilitate the well, the surging effect created by the device may force the chemical treatment into the gravel pack. Embodiments of the present invention that include a surge block may be particularly effective for rehabilitation purposes. Movement of the device up and down with the bore of the pipeline can provide the desired effect for rehabilitation of a well.

It is understood that the various embodiments of the present invention described above are exemplary and intended to illustrate the principles of the present invention. Various modifications to the present invention will be readily apparent to those of skill in the art upon reading this disclosure, and it is contemplated that such modifications are within the spirit and scope of the present invention.

The invention claimed is:

1. A device for cleaning the interior of a pipeline casing, the device comprising:

an axial support;

a first collar fixedly attached at a first location along the axial support;

a second collar fixedly attached at a second location along the axial support;

a third collar slidingly engaged with the axial support such that the second collar is located between the first collar and the third collar;

a spring fixedly attached to said second collar and said third collar and extending therebetween; and a flexible support fixedly attached to said third collar and said first collar and extending therefrom, the flexible support having a plurality of brush members disposed on an outward surface thereof, wherein when said third collar is at a first position along a length of the axial support, said flexible support is distended and when said third collar is at a second position along the length of the axial support, the second position being more distant from the first collar than the first position, the flexible support is flattened.

2. The device according to claim 1, wherein the axial support comprises an upper end and a lower end when in operable position within a vertical pipeline, the device further comprising a cable fixedly attached to the upper end of the axial support.

3. The device according to claim 1, wherein the axial support comprises an upper end and a lower end when in operable position within a vertical pipeline, the device further comprising a tube fixedly attached to the upper end of the axial support.

4. The device according to claim 1, wherein the axial support has a first end and a second end, further comprising a down view camera fixedly attached to the second end of the axial support.

5. The device according to claim 4 further comprising a light source fixedly attached to the second end of the axial support.

6. A device according to claim 1 further comprising a side view camera fixedly attached to said axial support along a length thereof.

7. The device according to claim 6 further comprising a light source fixedly attached to the axial support along the length thereof, the light source positioned to provide light to an area visualized by the side view camera.

8. The device according to claim 1 wherein the third collar is selectively positionable along the length of the axial support by an operator of the device.

9. The device according to claim 1, further comprising a surge block fixedly attached to said axial support.

10. The device according to claim 9, the surge block comprising a shaft and at least one seal member attached to said shaft and extending away from a surface thereof, the seal member adapted to contact the walls of a pipeline casing when the surge block is inserted therein.

11. The device according to claim 1, wherein the flexible support comprises a first member fixedly attached to said third collar, a second member hingedly attached to said first member, and a third member hingedly attached to said second member and fixed attached to said first collar.

12. The device according to claim 1 wherein the at least one axial support has a first end and a second end, the device further comprising a down view camera fixedly attached to the second end of the at least one axial support.

13. The device according to claim 12 further comprising a light source fixedly attached to the second end of said at least one axial support.

14. A device for cleaning the interior of a pipeline casing, the device comprising:

at least one axial support;

a first collar attached to a first location along one of said at least one axial support;

a second collar slidingly engaged with one of said at least one axial support;

a side view camera fixedly attached to said at least one axial support along a length thereof;

at least one flexible support attached to said first collar and said second collar, the at least one flexible support having a plurality of brush members disposed on an outward surface thereof, wherein when the second collar is at a first position along a length of one of said at least one axial support, said at least one flexible support is distended, and when said second collar is at a second position along a length of one of said at least one axial support, the first position being closer to said first collar than the second position, the at least one flexible support is flatter than when the second collar is at the first position.

15. The device according to claim 14, wherein at least one of the at least one axial support comprises an upper end and a lower end when in operable position within a vertical pipeline, the device further comprising an elongate connector fixedly attached to the upper end of at least one axial support, the elongate connector selected from the group consisting of a cable and a tube.

16. The device according to claim 14 further comprising a light source fixedly attached to said at least one axial support along a length thereof, the light source positioned to provide light to an area visualized by the side view camera.

* * * * *